United States Patent [19]

Brown

[11] Patent Number: 4,580,923

[45] Date of Patent: Apr. 8, 1986

[54] ACTUATING MEANS FOR A SERVO VALVE

[75] Inventor: Samuel K. Brown, Greencastle, Pa.

[73] Assignee: Ingersoll-Rand Company, Woodcliff Lake, N.J.

[21] Appl. No.: 640,868

[22] Filed: Aug. 15, 1984

[51] Int. Cl.[4] ..... E01C 19/00

[52] U.S. Cl. ..... 404/84; 74/105; 74/526; 318/587; 172/4.5

[58] Field of Search ..... 404/84; 74/96, 99 R, 74/105, 470, 526; 172/4.5; 318/587

[56] References Cited

U.S. PATENT DOCUMENTS

| | | | |
|---|---|---|---|
| 1,200,447 | 10/1916 | Albers | 74/99 R |
| 3,334,560 | 8/1967 | Long et al. | 404/84 |
| 3,519,770 | 7/1970 | Long et al. | 404/84 X |
| 3,846,035 | 11/1974 | Davin | 404/84 |

FOREIGN PATENT DOCUMENTS

| | | | |
|---|---|---|---|
| 1156331 | 6/1969 | United Kingdom | 404/84 |

*Primary Examiner*—Stephen J. Novosad
*Assistant Examiner*—John F. Letchford
*Attorney, Agent, or Firm*—B. J. Murphy

[57] ABSTRACT

The invention comprises a crank-linkage arrangement for a hydraulic servo valve, used on a road planer, to give the valve more sensitivity. It has a valve-operating crank coupled to a leverage-type linkage. The linkage responds to movements of a ground-engaging ski, which tracks the road surface, by displacing a same degree as does the ski, but by effecting a greater displacement of the crank. Limit stops on either sides of a limb of the linkage prevent any damaging overtravel of the crank.

13 Claims, 3 Drawing Figures

ACTUATING MEANS FOR A SERVO VALVE

This invention pertains to actuating means for valves and in particular to such actuating means particularly adapted for use with a hydraulic servo valve such as is used to control the grade or depth of planing of a road grader or surface planer.

Road or surface planers, or road graders, and the like commonly use ground-engaging skis to track or monitor the grade or depth of cut to be made in the pavement or surface being worked. In turn, the skis each send a signal to a servo valve which controls the hydraulics of the machine to cause the latter to elevate or lower or tilt. Such machines are well known in the prior art and, accordingly, require no exhaustive description here. Exemplary thereof is the machine disclosed in U.S. Pat. No. 4,139,318 issued to Jakob et al., on Feb. 13, 1979, for a "Method and Apparatus for Planing a Paved Roadway". Said patent, and its disclosure, are incorporated herein by reference.

The common, off-the-shelf, readily-available servo valves are adequately useful for the aforesaid purpose, with exceptions. They lack sufficient sensitivity, when they are actuated by linkage coupled to a ground-engaging ski. Also, they are subject to overtravel which causes them to exhibit spurious excursions.

It is an object of this invention, therefore, to set forth an actuating means for such standard or commercial servo valves to render the same more sensitive, and also to prevent extreme excursions of the valve.

It is particularly an object of this invention to set forth, for a servo valve, fixed on a bearing surface of a pavement working machine, and having an actuating shaft rotatable about a rotary axis, actuating means, comprising a crank, for attachment thereof to said shaft; and a limb; said limb having means, at a location intermediate the length thereof, for pivotable mounting thereof to the aforesaid same bearing surface; said limb further having first and second arms, of diverse lengths, integrally joined at said intermediate location; and linkage means, coupling said crank to one of said arms, for causing a given amount of displacement of said crank in response to another amount of displacement of the other of said arms.

It is also an object of this invention to disclose, in combination with a pavement-working machine, such as a surface planar, surface grader, or the like, having a surface profile-controlling servo valve, fixed on a bearing surface of the machine, and said valve having an actuating shaft rotatable about a rotary axis, actuating means for said valve, comprising a crank attached to said shaft; and a limb; said limb having means, at a location intermediate the length thereof, pivotably mounting said limb to said bearing surface; said limb further having first and second arms, of diverse lengths, integrally joined at said intermediate location; and linkage means, coupling said crank to one of said arms, for causing a given amount of displacement of said crank in response to another amount of displacement of the other of said arms.

Further objects of the invention, as well as the novel features thereof, will become more apparent by reference to the following description taken in conjunction with the accompanying figures in which.

Figure 1:
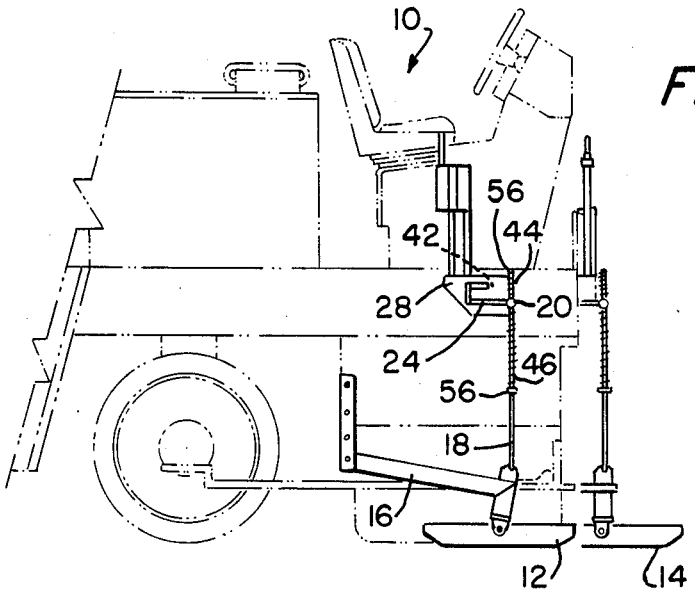
FIG. 1 is a side elevational view of a portion of a road planar having fixed thereto a pair of the novel valve actuating means according to an embodiment thereof.
Figure 3:
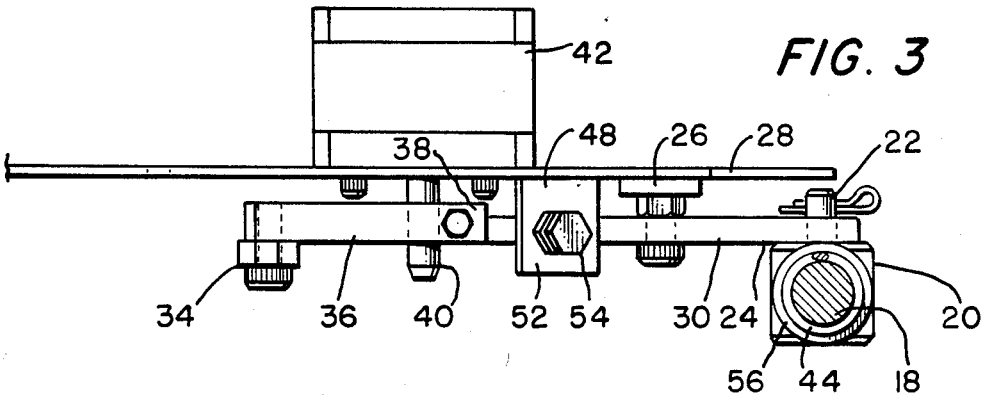
FIG. 3 is a plan or top view of the arrangement of FIG. 2.
Figure 2:
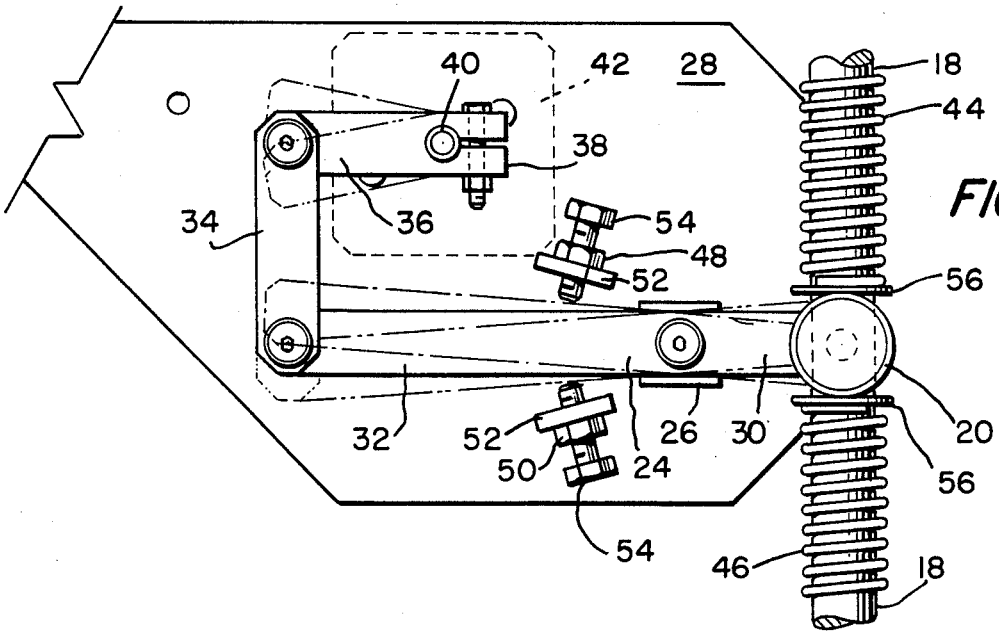
FIG. 2 is an enlarged, side elevational view of the details of the linkage arrangement of FIG. 1.

As shown in the figures a pavement or road planer 10 has a pair of ground engaging skis 12 and 14 fixed thereto. One 12 is shown in the foreground, and one 14 in the background, in that the machine has one on each side to track the grade. Each functions similarly, accordingly, the arrangement of the novel valve actuating means will be described in connection with the arrangement shown in the foreground. The ski 12 is attached to a T-shaped arm 16, the shank of the arm being pivotably coupled, at the end thereof, to the side of the machine at a bracket, and the cross-piece is coupled at either ends to the ski 12 and to an extended rod 18. The rod 18 is received in a movement sensor 20, the same being a circular element which is bored through slidably to accommodate the rod 18. The sensor 20 has a straight shank 22 extending therefrom for pivotable mounting thereof to a limb 24.

The limb 24 functions somewhat like a lever, being pivoted off center on a boss 26 carried on a mounting plate 28. Plate 28 is secured to the planar 10 by means not shown. The circular movement sensor 20 which receives the rod 18 is at one end of one short-length arm 30 of the limb 24. The end of the other long-length arm 32, of limb 24, is pivoted to a linkage 34 which, in turn, is coupled to one end of a crank 36. The crank has a clevis 38 at the other end by means of which it is clamped onto the rotary shank 40 of a servo valve 42. Valve 42 is bolted to the rear surface of the plate 28.

On each side of the rod 18, above and below the circular sensor 20, are fixed compression springs 44 and 46. Springs 44 and 46 damp the pivotable movement of limb 24 and, as will be explained, accommodate for excessive displacements of the ski 12.

Because of undulations of the road surface, the limb 24 will pivot on the boss 26 and turn the crank 36 of the servo valve 42. However, because of the disparate lengths of the arms 30 and 32 of the limb 24 a small movement of the arm 30 is translated into a greater movement of the arm 32 and, consequently the same greater movement of the crank 36. Crank 36 has a pivotable length, or a pivotable radius of a given length, and arm 30 has a same pivotable length or radius. Arm 32, however, has an approximately two and a half times greater length. Thus, the inventive arrangement, in this embodiment, increases the sensitivity of the servo valve 42 to excursions of the ski 12 two and a half times.

To insure that the limb 24 does not cause the crank 36 to go through inordinate excursions, there are limit stops 48 and 50 fixed on either side of the limb 24. Tabs 52 welded to the mounting plate 28 extend therefrom and receive limit-stop, adjusting, cap screws 54. If the circular sensor 20 is displaced to a limit fixed by one of the cap screws 54, either one or the other of the springs 44 or 46 will compress and allow the rod 18 to pass through the sensor 20 without causing damage to the servo valve 42. The springs 44 and 46 are fixed between washers 56, there being a pair thereof at either sides of the sensor 20, one at the upper end of the rod 18—and secured by a cotter pin, and one intermediate the length of the rod between the sensor 20 and the T-shaped arm 16—the latter also being fixed thereat by a cotter pin. Spring 44 absorbs a two-inch excess drop of the ski 12, and spring 46 absorbs an eight-inch excessive elevation of the ski.

While I have described my invention in connection with specific embodiments thereof, and a particular method of its practice, it is to be clearly understood that this is done only by way of example and not as a limitation to the scope of my invention as set forth in the objects thereof and in the appended claims.

I claim:

1. For a servo valve, fixed on a bearing surface of a pavement working machine, and having an actuating shaft rotatable about a rotary axis, actuating means therefor comprising:

a crank, for attachment thereof to said shaft; and a limb;

said limb having means, at a location intermediate the length thereof, for pivotable mounting thereof to the aforesaid same bearing surface;

said limb further having first and second arms, of diverse lengths, integrally joined at said intermediate location; and linkage means, coupling said crank to one of said arms, for causing a given amount of displacement of said crank in response to another amount of displacement of the other of said arms; wherein said limb has a movement sensor coupled thereto.

2. Actuating means, according to claim 1, wherein:

said crank has first means defining an aperture for engaging said shaft, and second means for pivotable coupling thereof to said linkage means;

said first and second means are a given distance apart; and said other arm of said limb has a length of a dimension which substantially corresponds to said given distance.

3. Actuating means, according to claim 1, wherein:

said other arm has a given length; and said one arm has a length which is a multiple of said given length.

4. Actuating means, according to claim 1, wherein:

said sensor is pivotably coupled to said limb.

5. Actuating means, according to claim 1, wherein:

said sensor has a borehole formed therethrough; and further including a rod in slidable penetration of said borehole; and further including a pavement-engaging ski coupled to an end of said rod.

6. Actuating means, according to claim 5, wherein:

the opposite end of said rod projects beyond said sensor;

said opposite end having a termination; and further including first biasing means, engaged with said opposite end of said rod and constrained between said termination and said sensor, resiliently to restrain said opposite end in a given position relative to said sensor; and second biasing means, engaged with said one end of said rod, and interposed between said ski and said sensor, resiliently to restrain said opposite end in a prescribed position relative to said sensor.

7. In combination with a pavement-working machine, such as a surface planer, surface grader, or the like, having a surface profile-controlling servo valve, fixed on a bearing surface of the machine, and said valve having an actuating shaft rotatable about a rotary axis, actuating means for said valve, comprising:

a crank attached to said shaft; and a limb;

said limb having means, at a location intermediate the length thereof, pivotably mounting said limb to said bearing surface;

said limb further having first and second arms, of diverse lengths, integrally joined at said intermediate location; and linkage means, coupling said crank to one of said arms, for causing a given amount of displacement of said crank in response to another amount of displacement of the other of said arms.

8. The combination, according to claim 7, wherein:

said crank has an aperture formed therein for engaging said shaft, and a pivot hole formed therein for pivotable coupling thereof to said linkage means;

said aperture and pivot hole are a given distance apart; and said other arm of said limb has a length of a dimension which substantially corresponds to said given distance.

9. The combination, according to claim 7, wherein:

said other arm has a given length; and said one arm has a length which is a multiple of said given length.

10. The combination, according to claim 7, wherein:

said limb has a movement sensor coupled thereto.

11. The combination, according to claim 10, wherein:

said sensor is pivotably coupled to said limb.

12. The combination, according to claim 10, wherein:

said sensor has a borehole formed therethrough; and further including a rod in slidable penetration of said borehole; and further including a pavement-engaging ski coupled to an end of said rod.

13. The combination, according to claim 12, wherein:

the opposite end of said rod projects beyond said sensor;

said opposite end having a termination; and further including first biasing means, engaged with said opposite end of said rod and constrained between said termination and said sensor, resiliently to restrain said opposite end in a given position relative to said sensor; and second biasing means, engaged with said one end of said rod, and interposed between said ski and said sensor, resiliently to restrain said opposite end in a prescribed position relative to said sensor.

* * * * *